US005333851A

United States Patent [19]

Kulpa

[11] Patent Number: 5,333,851

[45] Date of Patent: Aug. 2, 1994

[54] DOCUMENT CORNER TURNING BELT TRANSPORT APPARATUS AND METHOD

[75] Inventor: Walter J. Kulpa, Trumbull, Conn.

[73] Assignee: Pitney Bowes Inc., Stamford, Conn.

[21] Appl. No.: 998,504

[22] Filed: Dec. 30, 1992

[51] Int. Cl.[5] ..... B65H 5/00

[52] U.S. Cl. ..... 271/225; 271/184

[58] Field of Search ..... 271/225, 184–186; 226/197

[56] References Cited

U.S. PATENT DOCUMENTS 4,844,442 7/1989 Gämmerler ..... 271/225

FOREIGN PATENT DOCUMENTS 54-57759 5/1979 Japan ..... 271/225

*Primary Examiner*—David H. Bollinger

*Attorney, Agent, or Firm*—Robert H. Whisker; Melvin J. Scolnick

[57] ABSTRACT

Apparatus and a method for guiding and controlling a discrete item through a turn in the feed direction. The apparatus includes: a stationary cylinder; a transport belt having an input end and an output end for conveying the discrete item halfway around the circumference of the stationary cylinder, the feed direction of the transport belt being oriented at an angle to the axis of the stationary cylinder, and wherein an intermediate portion of the transport belt wraps around the half of the cylinder circumference remote from both the input and output ends of the transport belt; and a device to support the transport belt and provide a gap between the transport belt and the stationary cylinder, whereby the discrete item is turned in the feed direction when conveyed by the transport belt halfway around the stationary cylinder.

9 Claims, 6 Drawing Sheets

46

DOCUMENT CORNER TURNING BELT TRANSPORT APPARATUS AND METHOD

BACKGROUND OF THE INVENTION

The instant invention relates to apparatus and a method for turning discrete documents in their feed direction, and more particularly to such apparatus and method which does not require acceleration or deceleration of the discrete documents.

Making a turn in the feed direction has long been established with continuous web stock. Making a turn with discrete items has usually required either stopping the forward movement of the item and then accelerating it in the new direction or pivoting it about one of its corners. The first method requires a deceleration to zero velocity in the original direction and then an acceleration in the ninety degree direction. The deceleration and acceleration intrinsically take more time than a method that maintains the item being turned at a constant transport velocity. The pivoting method also requires that some portions of the item experience a deceleration/acceleration cycle of some degree to produce the pivoting motion. Deceleration and acceleration rates are limited by the ability of the motors and/or controllers to produce the desired motion and the ability to hold and control the item.

Accordingly, the instant invention employs a turning apparatus and method which maintains the item being turned at a constant speed which results in a less complicated system and higher throughput.

SUMMARY OF THE INVENTION

The instant invention therefore provides apparatus and a method for guiding and controlling a discrete item through a turn in the feed direction. The apparatus includes: a stationary cylinder; a transport belt having an input end and an output end for conveying the discrete item halfway around the circumference of the stationary cylinder, the feed direction of the transport belt being oriented at an angle to the axis of the stationary cylinder, and wherein an intermediate portion of the transport belt wraps around the half of the cylinder circumference remote from both the input and output ends of the transport belt; and a device to support the transport belt and provide a gap between the transport belt and the stationary cylinder, whereby the discrete item is turned in the feed direction when conveyed by the transport belt halfway around the stationary cylinder.

The method includes: transporting a discrete item along a first, horizontal path toward a stationary cylinder having an axis oriented at an angle to the first, horizontal path; transporting the discrete item in a helical pattern halfway around the stationary cylinder while maintaining a gap between the discrete item and the stationary cylinder; and transporting the discrete item away from the stationary cylinder in a second, horizontal path angled to the first, horizontal path, whereby the discrete item is turned.

DETAILED DESCRIPTION OF THE PREFERRED EMBODIMENT

Figure 1:
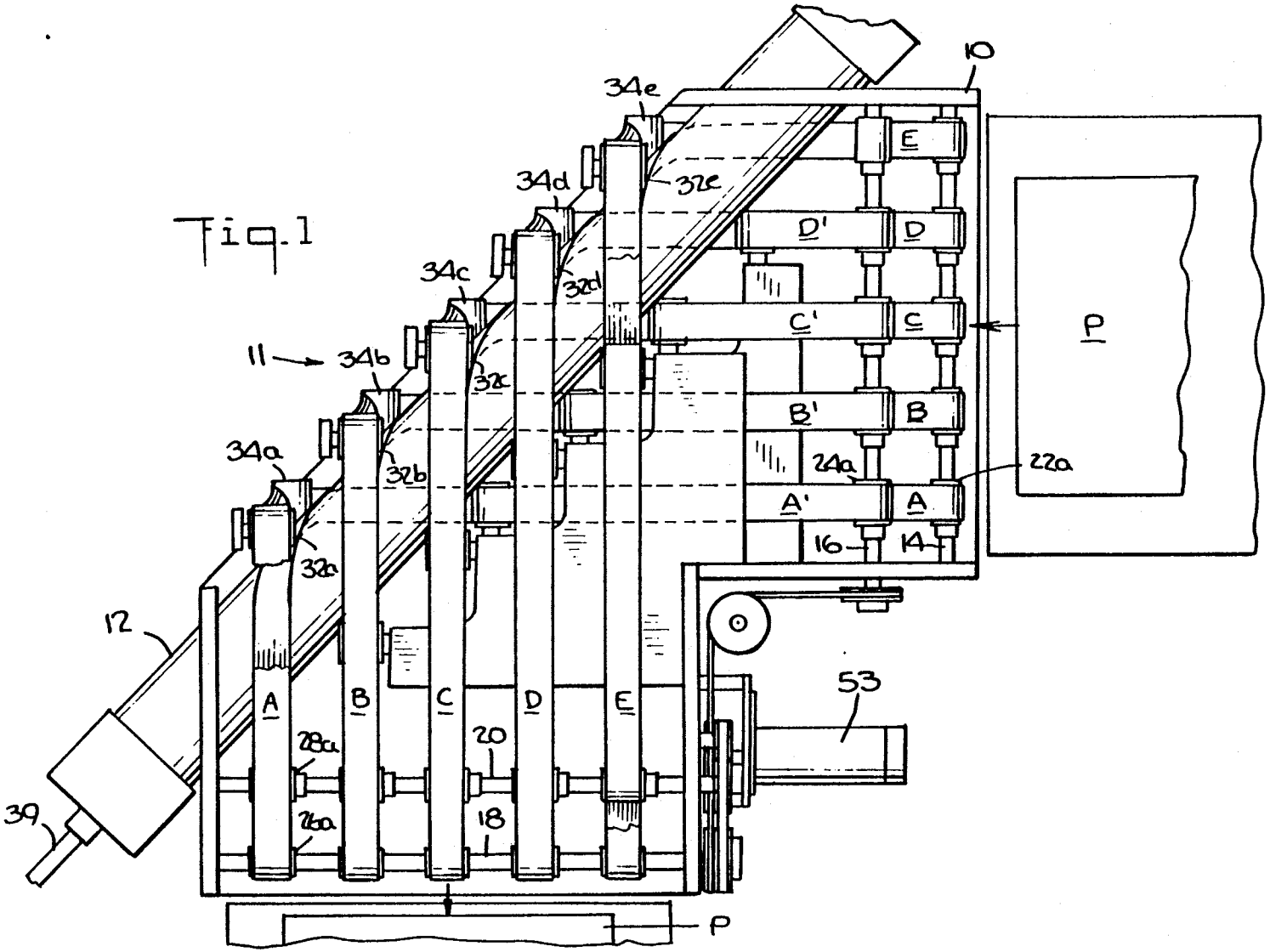
FIG. 1 is a top, plan view of document turning apparatus in accordance with the instant invention.
Figure 2:
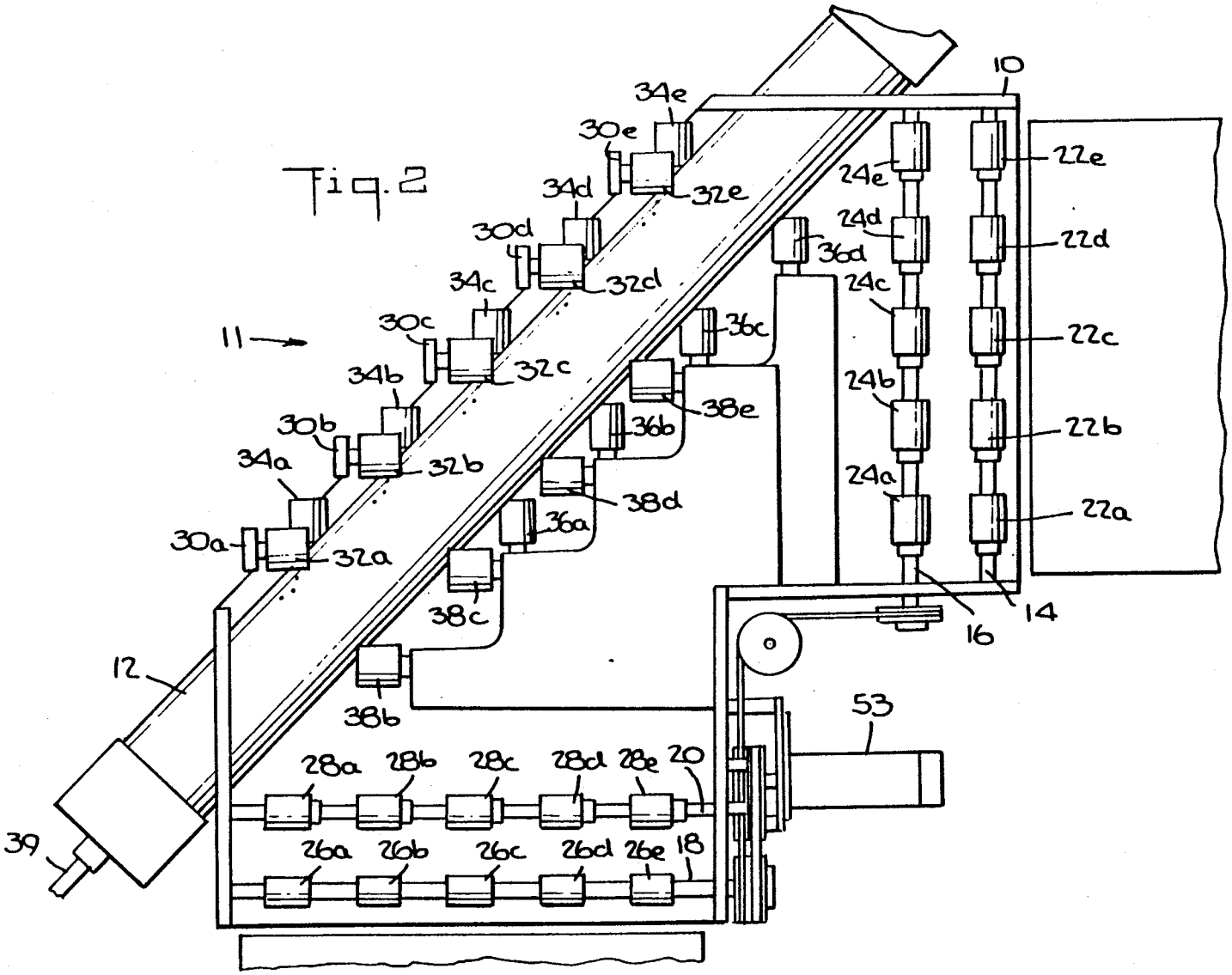
FIG. 2 is similar to FIG. 1 except that the flat belts have been removed for clarity.
Figure 3:
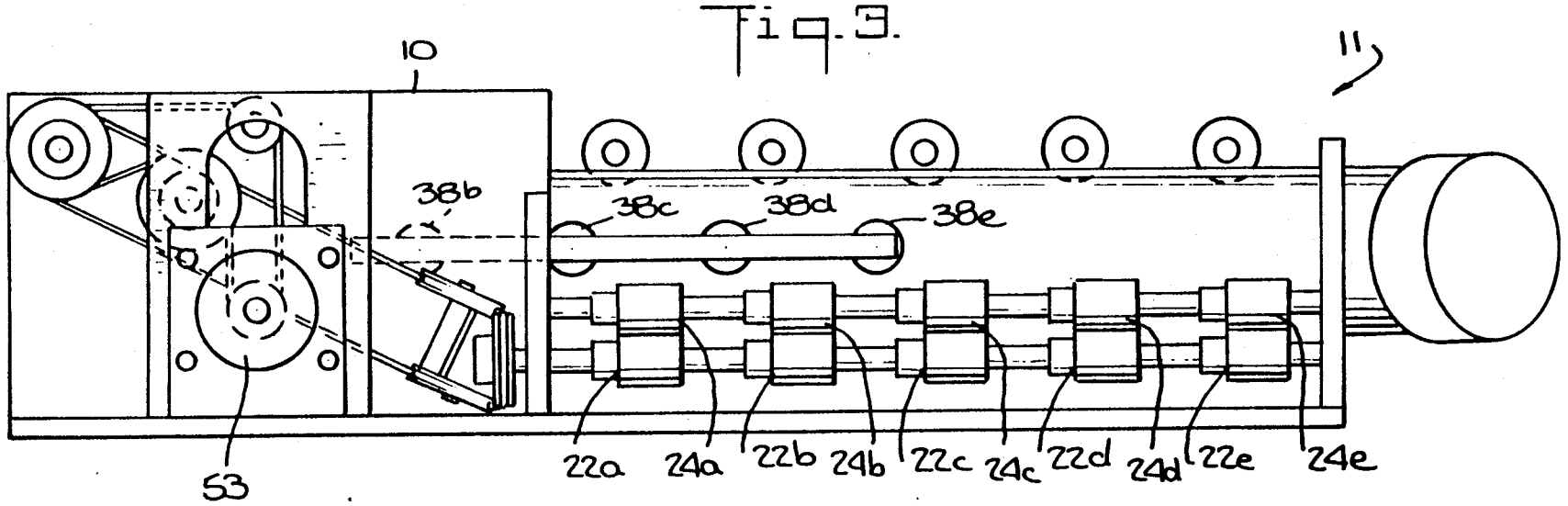
FIG. 3 is a front, elevational view of the apparatus seen in FIG. 2 looking from the direction of input.
Figure 4:
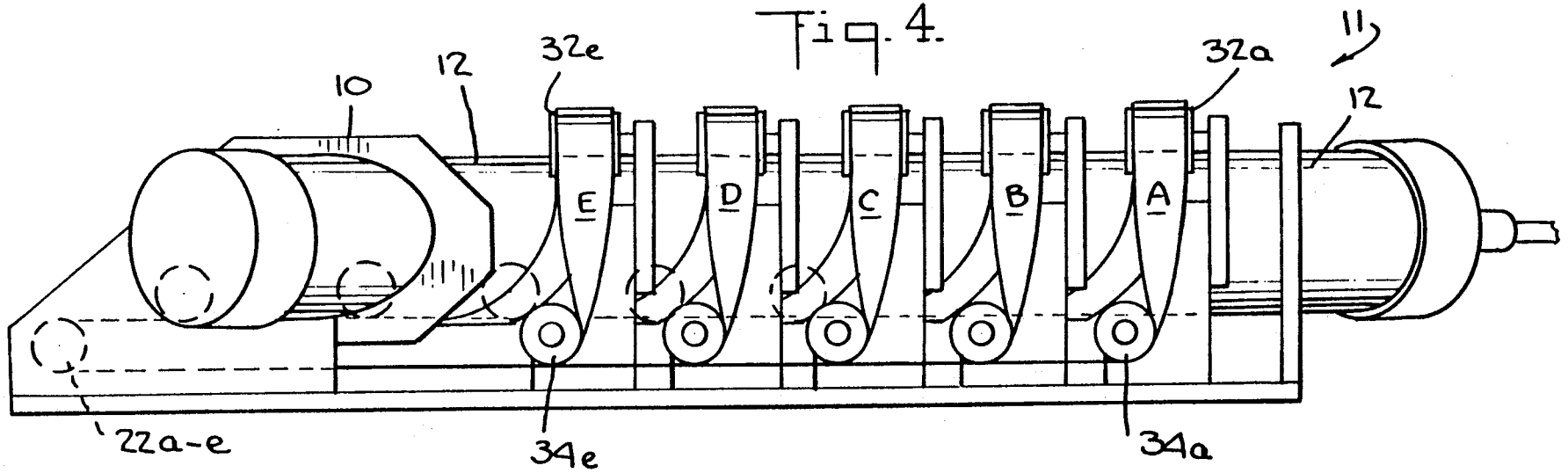
FIG. 4 is a side, elevational view of the apparatus seen in FIG. 1 looking toward the direction of output.

In describing the preferred embodiment of the instant invention, reference is made to the drawings wherein there is seen a document turner for generating a 90 degree turn generally designated 11 having a housing frame 10 which supports an enclosed cylinder 12 and a pair of shafts 14 and 16 at the input end of the turner 10. A pair of shafts 18 and 20 are mounted at the output end of the housing frame 10. Five rollers 22*a, b, c, d* and *e* (see FIG. 2) are fixedly mounted on shaft 14. Five rollers 24*a, b, c, d* and *e* are fixedly mounted on shaft 16. Similarly, five rollers 26*a, b, c, d* and *e* are fixedly secured on the shaft 18, and five rollers 28*a, b, c, d* and *e* are fixedly mounted on the shaft 20.

Secured to the housing frame 10 adjacent the cylinder 12 are five brackets 30*a, b, c, d* and *e*, each of which supports an upper roller 32*a, b, c, d* and *e* respectively and a lower roller 34*a, b, c, d* and *e* respectively. The upper rollers 32 *a–e* are oriented perpendicular to the lower rollers 34 *a–e*.

Figure 5:
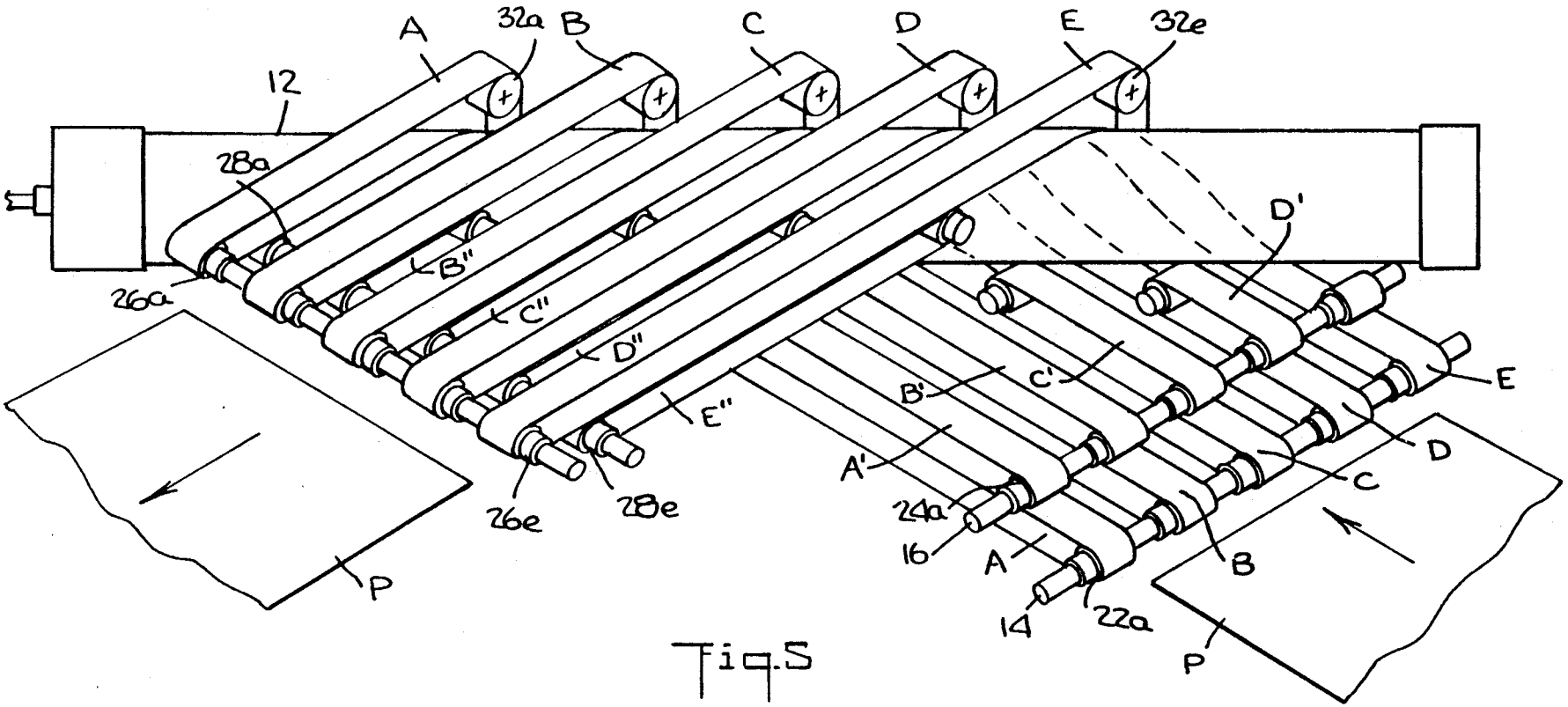
FIG. 5 is a top, perspective view of the apparatus seen in FIG. 1.
Figure 6:
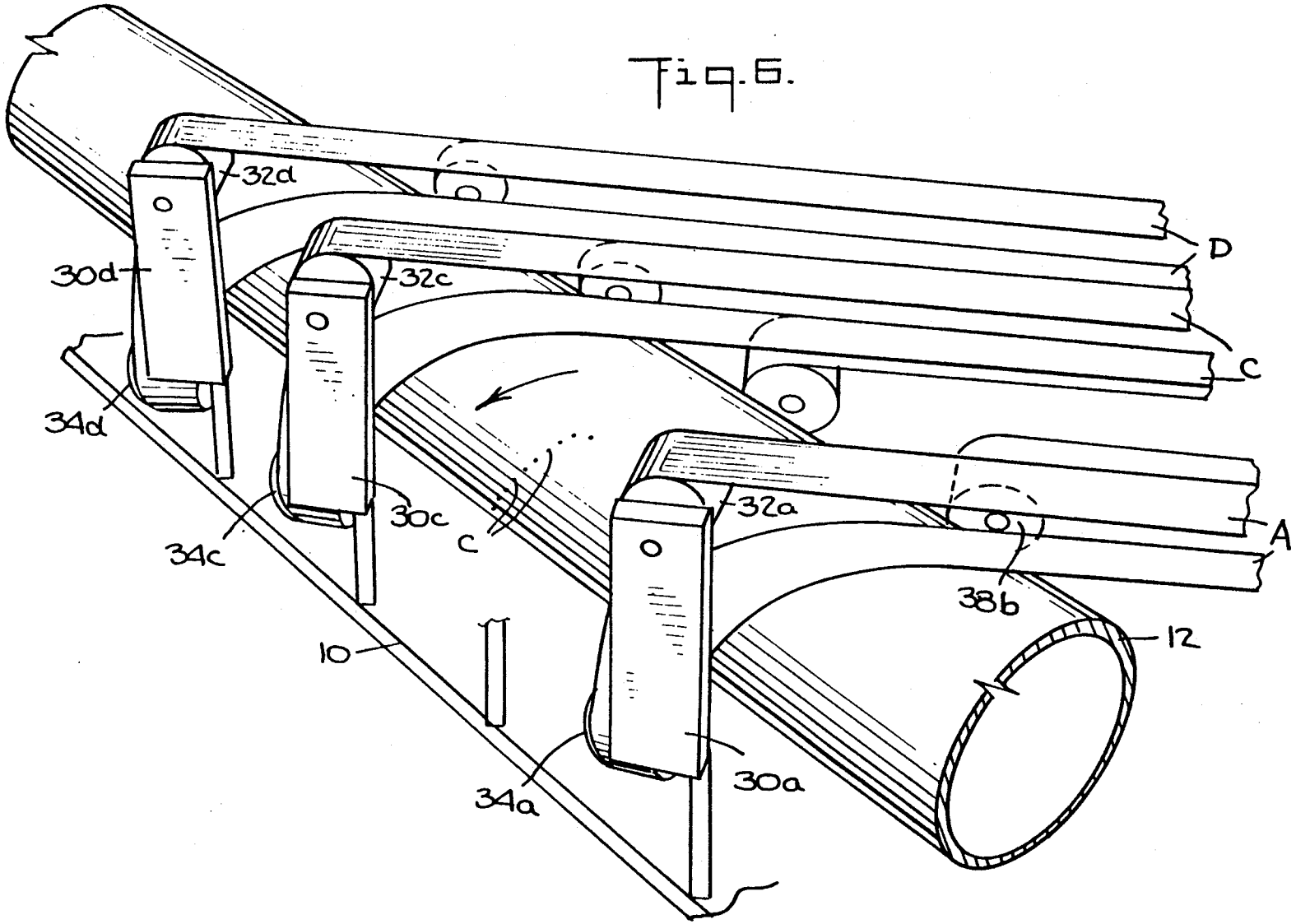
FIG. 6 is an enlarged, perspective view of the turning cylinder and flat belts seen in FIGS. 1–5.

As best seen in FIG. 5, five identical elastic transport belts A, B, C, D and E of equal length are trained over the rollers 22*a–e*, 34*a–e*, 32*a–e* and 26*a–e*. The paths of each of the belts A–E are identical, and will be explained with regard to the belt A, which explanation will pertain to the remaining belts B–E. The belt A, at its input end, wraps around the roller 22*a;* the upper and lower reaches of the belt A then continue toward the cylinder 12 which is oriented at an angle of 45 degrees to the output end of the belt A; the lower reach wraps around the roller 34*a* and the upper reach wraps around the cylinder 12 and then the lower reach turns upward and around the cylinder 12 by twisting perpendicular around the roller 32*a* which is oriented perpendicular to the roller 34*a*. The upper reach wraps through a helical path around the cylinder 12 as best seen in FIG. 6. The upper and lower reaches of the belt A then continue horizontally at the output end (also oriented at a 45 degree angle to the cylinder 12) toward and wrap around the roller 26*a*. The remaining belts B–E travel similar paths to that of the belt A in order to wrap around the cylinder 12.

Also secured to the housing frame 10 are four rollers 36*a, b, c,* and *d* (see FIG. 2) which are aligned respectively with the rollers 24*a, b, c* and *d*. Similarly secured to the housing frame 10 are rollers 38*b, c, d* and *e* which are aligned respectively with the rollers 28*b, c, d* and *e*.

Four input feeder belts A', B', C' and D' are oriented at 45 degrees to the cylinder 12 and trained respectively over the roller pairs 24*a* and 36*a*, 24*b* and 36*b*, 24*c* and 36*c*, and 24*d* and 36*d*. The lower reaches of the belts A', B', C' and D' are adjacent the upper reaches of the belts A, B, C and D respectively. The roller 24*e* functions without a mating roller and belt as in the case of the rollers 24*a–d*.

Four output feeder belts B″, C″, D″ and E″ also oriented at 45 degrees to the cylinder 12 are trained respectively over the roller pairs 28*b* and 38*b*, 28*c* and 38*c*, 28*d* and 38*d*, and 28*e* and 38*e*. The upper reaches of the belts B″, C″, D″ and E″ are adjacent the lower reaches of the belts B, C, D and E respectively. The roller 28*a* functions without a mating roller and belt as in the case of the rollers 28*b–e*. All of the above described belts are driven by a motor 53.

It is critical that the transport belts A–E move around the cylinder 12 in a helical fashion without incurring frictional resistance between the belts A–E and the cylinder 12. The cylinder 12 cannot be allowed to rotate because rotation, together with frictional contact, would produce a force in a direction tangent to the cylinder 12 instead of helically around it, the desired direction of the paper path. Since the cylinder 12 needs to be stationary and the frictional force between the cylinder 12 and the belts A–E must be eliminated, air is supplied by a blower 39 to the interior of the cylinder 12 which has a pattern of air injection holes a–e in the paper path half of its circumference. This air supports the belts A–E and allows them to proceed around the cylinder 12 with essentially no frictional contact.

It is also important to the success of the instant invention that the transport belts A–E be elastic and consist of multiple, narrow belts rather than one, wide belt. Narrow, elastic belts A–E are used since they can be urged to follow the correct helical path. The air, which forms the air bearing 51, is injected through the rows of holes a–e (see FIG. 7) which are located along the centerline of the helical belt path around the cylinder 12. This causes the highest air pressure to occur under the desired center of each belt A–E. Since the belts A–E are elastic, each one of the belts A–E is lifted off the cylinder 12 the maximum along this centerline path, which creates a crowned-roller effect along the path. Each belt A–E aligns its centerline to the row of holes a–e respectively around the cylinder 12 just as it would align to a crowned roller. A single, wide belt instead of the five belts A–E would not have sufficient crowning to produce this alignment. Obviously, there may be some applications where a single transport belt would suffice.

Figure 7:
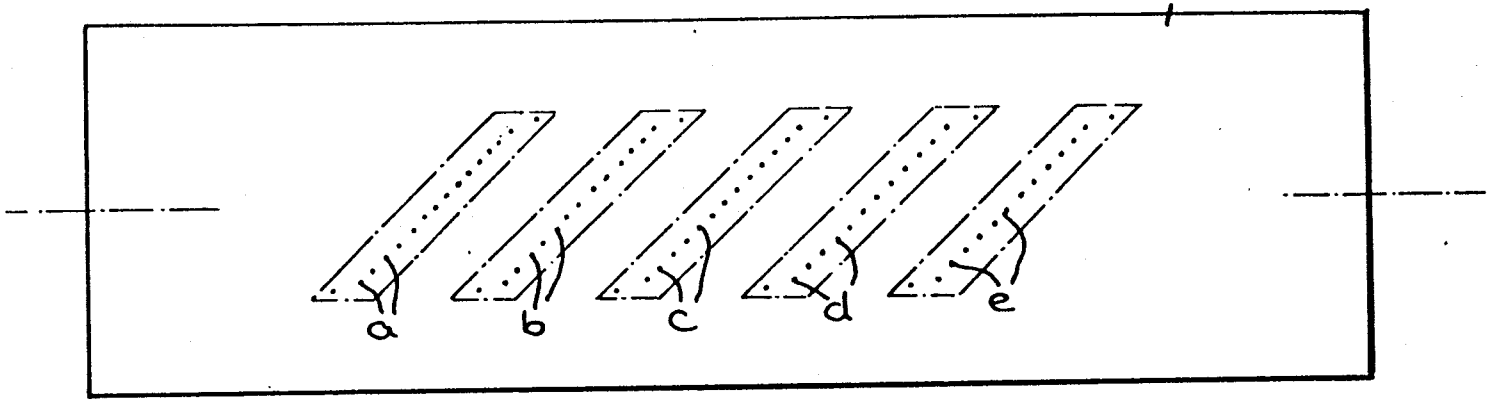
FIG. 7 is an enlarged, perspective view of the turning cylinder and its helical patterns of air holes.
Figure 9:
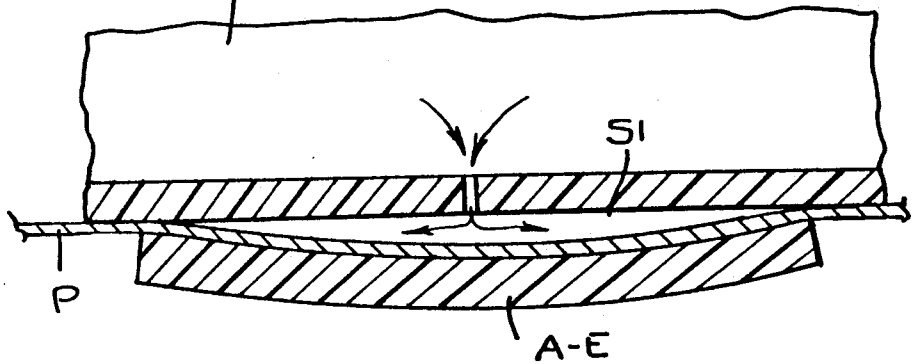
FIG. 9 is a sectional view taken on the plane indicted by the line 9—9 in FIG. 8.
Figure 8:
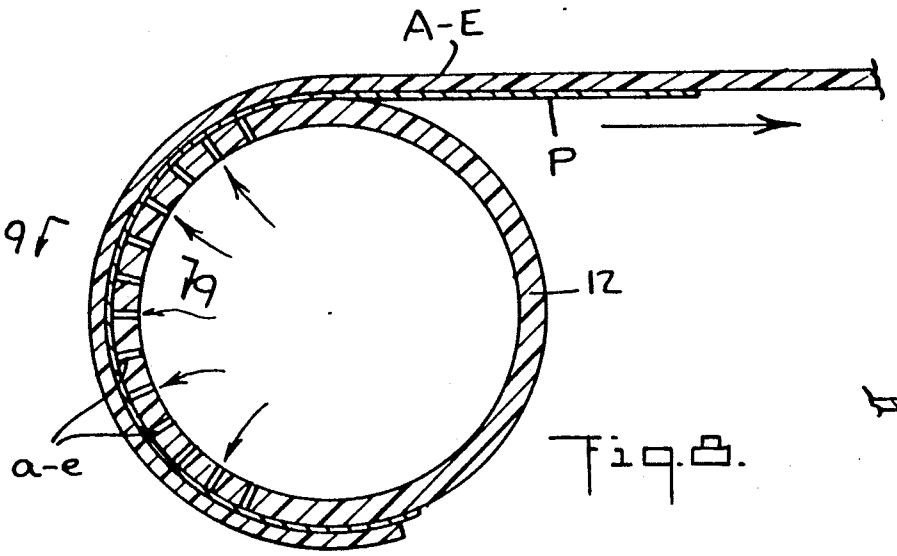
FIG. 8 is a sectional view through the turning cylinder and a flat belt.

FIG. 7 shows the pattern of the air injection holes a–e made in the paper path half of the circumference of the cylinder 12. The pattern is shown as it would appear if the cylinder 12 were split along a horizontal seam and laid flat. Note that most of the holes a–e lie along straight lines that form the centerline of the paths of the belts A–E. At each end of each of these lines a–e is a hole which is offset from the others. These offset holes provide the air to support the belts A–E where they enter and leave the cylinder 12. The dashed lines outline the projected areas on the transport belts A–E where they are supported on the air bearing created by the air injected through the holes a–e respectively. In the embodiment shown, the holes a–e lie along a 45 degree helical path which is consistent with a 90 degree corner turn. Other helical paths which are not 45 degrees would be consistent with turns other than 90 degrees. In one embodiment, a cylinder 12 with an outside diameter of 3.5 inches was chosen to eliminate the wrinkling of an envelope due to the shearing forces it experienced in traveling around the cylinder 12. If the intended application is for single sheets of paper, the diameter of the cylinder 12 could be 2 or less inches.

The number of holes a–e required to create the air bearing is dependent on the circumference of the cylinder 12 and thus the length of the projected area of the transport belts A–E. The number of holes a–e can be reduced if they are connected together with a groove (not shown) along the surface of the cylinder 12. Using a greater number of holes a–e or a groove with fewer holes will produce the desired result of creating a ridge of higher pressure air along the center of the path of the belts A–E. In the embodiment shown, thirteen holes with a diameter of 1/16 inch were used along the center of the belt path; the additional offset holes were also 1/16 inch in diameter. The enclosed cylinder 12 serves as a plenum to deliver air to all of the holes a–e with no significant pressure drop.

The embodiment shown uses five transport belts A–E to allow it to handle the full range of envelope sizes including flats. It can be easily seen that this apparatus is not sensitive to the location of the registration edge of the items being transported. Wherever or however the items enter the input side, their orientation and position will be maintained relative to the transport belts A–E. However, the most conservative paper path designs would have the leading corner of the item located within the width of a belt so that the leading corner can be directed along the desired helical path.

The air pressure required is dependent on the tension of the belts A–E, which in turn is dependent on the elastic modulus of the belt material, and its cross sectional area and elongation. In the embodiment shown, the belts A–E were each elastic and 1.25 inch wide, and 2.5 p.s.i. was used to generate a belt tension of approximately seventeen pounds.

The volume flow rate of air is also dependent on the circumferential belt path length on the cylinder 12. This is due to the fact that air is constantly leaking from the edges and ends of the belts A–E in order to keep them from contacting the cylinder 12. Thus, the larger the diameter of the cylinder 12 and the number of belts, the larger the amount of air that is needed to produce the air bearing. In the embodiment shown, a total of $\frac{1}{3}$ cubic foot of air per minute was required, which produced a 0.013 inch film of air at the edges of the belts A–E.

It can be seen that with the corner transport described hereinabove, the discrete item being transported is always under the control of the belts A–E. The location and speed of the transported item can be controlled, and therefore changed while it is at any position within the turn. The items can even be brought to a complete stop so that the corner transport can serve as an arming station for another process. It can also be seen that the roles of the input and output ends of the turner 11 can be interchanged.

The embodiment described is effective to turn a discrete document 90 degrees in the direction of feed. But it should be understood that the apparatus and method of the instant invention can be used to effect a turn of any degree. If a turn of 45 degrees is desired, the cylinder 12 is simply oriented at an angle of 22.5 degrees; other angles of turn are possible, and the orientation of the cylinder 12 would be adjusted accordingly.

It should be understood by those skilled in the art that various modifications may be made in the present invention without departing from the spirit and scope thereof, as described in the specification and defined in the appended claims.

What is claimed is:

1. Apparatus for guiding and controlling a discrete item through a turn in the feed direction, comprising:

a stationary cylinder;

a transport belt having an input end and an output end for conveying said discrete item halfway around the circumference of said stationary cylinder, the feed direction of said transport belt being oriented at an angle to the axis of said stationary cylinder, and wherein an intermediate portion of said transport belt wraps around the half of the cylinder remote from both the input and output ends of said transport belt;

means to support said transport belt and provide a gap between said transport belt and said stationary cylinder wherein said cylinder includes a pattern of holes helically aligned on said cylinder adjacent said transport belt, wherein said supporting means comprises a film of air between said transport belt and said cylinder; and a blower for supplying said air through said holes in said cylinder, whereby said discrete item is turned in the feed direction when conveyed by said transport belt half way around said stationary cylinder.

2. The apparatus of claim 1, wherein said item comprises paper.

3. The apparatus of claim 2, wherein said transport belt comprises an elastic material.

4. The apparatus of claim 3, additionally comprising an input feeder belt having a lower reach adjacent the upper reach of the input end of said transport belt and an output feeder belt having an upper reach adjacent the lower reach of the output end of said transport belt.

5. The apparatus of claim 4, wherein said turn comprises 90 degrees.

6. The apparatus of claim 5, wherein said angle is 45 degrees, and whereby said discrete item is turned 90 degrees when conveyed by said transport belt halfway around said stationary cylinder.

7. The apparatus of claim 1, wherein said turn comprises 90 degrees.

8. An apparatus of claim 7, wherein said angle is 45 degrees, said first, horizontal path is oriented perpendicular to said second, horizontal path, and said discrete item is turned 90 degrees.

9. A method for guiding and controlling a discrete item through a turn in the feed direction, comprising:

providing a stationary cylinder and a transport belt having in input end and an output end for conveying the discrete item halfway around the circumference of said stationary cylinder;

providing said stationary cylinder with a plurality of holes helically aligned on said cylinder adjacent said transport belt;

providing an air supply for sending air through said holes in said cylinder to maintain a gap of air between said transport belt and said stationary cylinder;

transporting said discrete item along a first, horizontal path toward said stationary cylinder having an axis oriented at an angle to said first, horizontal path;

transporting said discrete item in a helical pattern halfway around said stationary cylinder while the gap of air between said discrete item and said stationary cylinder; and transporting said discrete item away from said stationary cylinder in a second, horizontal path angled to said first horizontal path, whereby said discrete item is turned in the feed direction.

* * * * *